US009302838B2

(12) United States Patent
Frank et al.

(10) Patent No.: US 9,302,838 B2
(45) Date of Patent: Apr. 5, 2016

(54) EASY OPENING BAG

(71) Applicant: The Procter & Gamble Company, Cincinnati, OH (US)

(72) Inventors: Martin Werner Frank, Hofheim (DE); Hedwige Clara Theophiel Verherbrugghen, Overmere (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/086,096

(22) Filed: Nov. 21, 2013

(65) Prior Publication Data

US 2014/0151260 A1 Jun. 5, 2014

Related U.S. Application Data

(60) Provisional application No. 61/731,484, filed on Nov. 30, 2012.

(51) Int. Cl.

| | |
|---|---|
| ***B65D 77/38*** | (2006.01) |
| ***B65B 1/02*** | (2006.01) |
| ***B65D 30/10*** | (2006.01) |
| ***B65D 30/08*** | (2006.01) |
| ***B65D 75/58*** | (2006.01) |

(52) U.S. Cl.

CPC . *B65D 77/38* (2013.01); *B65B 1/02* (2013.01); *B65D 31/04* (2013.01); *B65D 31/16* (2013.01); *B65D 75/5827* (2013.01)

(58) Field of Classification Search

CPC ..... B65D 31/10; B65D 75/008; B65D 31/00; B65D 75/5833; B65D 75/5811; B65D 85/16; B65D 75/5805; B65D 75/58; B65D 75/12; B65D 75/5816; B65D 75/20; B65D 75/30; B65D 77/38; B65D 31/16; B65D 31/04; B65D 75/5827; B65B 1/02

USPC ..... 383/120, 207–209

See application file for complete search history.

(56) References Cited

U.S. PATENT DOCUMENTS

| | | | | | |
|---|---|---|---|---|---|
| 3,399,760 | A | * | 9/1968 | Hechler, IV | 383/207 |
| 3,480,198 | A | * | 11/1969 | Repko | 383/203 |
| 3,790,744 | A | | 2/1974 | Bowen | |
| 4,603,537 | A | * | 8/1986 | Pace | 53/415 |
| 5,001,325 | A | | 3/1991 | Huizinga | |
| 5,158,499 | A | | 10/1992 | Guckenberger | |
| 5,229,180 | A | | 7/1993 | Littmann | |
| 5,352,466 | A | * | 10/1994 | Delonis | 426/123 |

(Continued)

FOREIGN PATENT DOCUMENTS

FR 2973351 10/2012

OTHER PUBLICATIONS

PCT International Search Report and Written Opinion for PCT/US2013/069806, dated Feb. 13, 2014.

*Primary Examiner* — Nathan J Newhouse
*Assistant Examiner* — Peter Helvey
(74) *Attorney, Agent, or Firm* — John T. Dipre; Steven W. Miller

(57) ABSTRACT

An easy opening bag comprising corner seals. A line of weakness extends from at least a portion of a first panel of the bag into at least a portion of a first corner seal of the bag, wherein the line of weakness is: a dashed line in the first panel; and a continuous line in the first corner seal, and wherein the dashed line in the first panel and the continuous line in the first corner seal abut.

16 Claims, 4 Drawing Sheets

(56) References Cited

U.S. PATENT DOCUMENTS

| | | | | |
|---|---|---|---|---|
| 5,392,589 | A * | 2/1995 | Buchanan | 53/412 |
| 5,511,664 | A * | 4/1996 | Aramaki et al. | 206/525 |
| 5,842,790 | A * | 12/1998 | Imer | 383/122 |
| 6,213,645 | B1 * | 4/2001 | Beer | 383/211 |
| 6,984,067 | B2 * | 1/2006 | Tokita | 383/1 |
| 8,173,233 | B2 * | 5/2012 | Rogers et al. | 428/36.5 |
| 8,210,746 | B2 * | 7/2012 | Kerr et al. | 383/67 |
| 8,622,619 | B2 * | 1/2014 | Adams et al. | 383/207 |
| 2002/0068668 | A1 | 6/2002 | Chow et al. | |
| 2003/0019780 | A1 * | 1/2003 | Parodi et al. | 206/524.1 |
| 2003/0051440 | A1 * | 3/2003 | Chow et al. | 53/412 |
| 2003/0231811 | A1 | 12/2003 | Hodson et al. | |
| 2004/0013325 | A1 * | 1/2004 | Cook | 383/104 |
| 2007/0042885 | A1 | 2/2007 | Rietjens et al. | |
| 2007/0237434 | A1 | 10/2007 | McKellar | |
| 2008/0131035 | A1 | 6/2008 | Rogers | |
| 2009/0190866 | A1 | 7/2009 | Hughes | |
| 2010/0226598 | A1 | 9/2010 | Stoeppelmann | |
| 2012/0156437 | A1 | 6/2012 | Willey | |
| 2013/0330027 | A1 * | 12/2013 | Axe et al. | 383/120 |

* cited by examiner

EASY OPENING BAG

FIELD OF THE INVENTION

The present invention relates to an easy opening bag and a process for making the easy opening bag.

BACKGROUND OF THE INVENTION

Bags with corner seals have been used to package a wide variety of consumer products, including granular laundry detergents. Such bags with corner seals deliver improved standability, thus displaying the products on shelf better versus other types of bags, e.g., gusset and pillow bags.

In terms of the manufacturing process, corner seals are usually achieved by folding a portion of the film forming the bag on itself and then sealing the overlapping surfaces of the film. The resulting corner seals are thicker than other areas of the bag and therefore are rigid enough to stand and support the bag.

However, such thicker corner seals increase the difficulty of opening the bag, particularly along a line of weakness. Lines of weakness have long been applied to bags for the purpose of easy opening, but the thicker corner seals stop the propagation of a tearing along a line of weakness. A user sometimes cannot open the bag without resorting to scissors, knives, or other inconvenient or dangerous ways of opening the bag. Alternatively, some proposed solutions lead to an uncontrolled tearing. The user may attempt to tear open a bag, resulting in the contents undesirably spilling out. This is particularly problematic in larger bags where the bag contains multiple doses of the consumer product and the user only intends to remove a single dose at a time. Some designs may even have led to pre-mature opening during distribution.

Thus, there is a need to provide an easy opening bag with corner seals, i.e., enabling a controlled tearing of the bag along a line of weakness including crossing a corner seal.

It is an advantage of the present invention to provide a bag with corner seals that withstands typical filling, packing, handing, and other distribution related processes, and yet is easily opened by the user.

SUMMARY OF THE INVENTION

In one aspect, the present invention is directed to an easy opening bag, comprising a first panel, a second panel, a third panel, and a fourth panel, wherein the first panel is: i) adjacent to the second panel and the fourth panel; and ii) opposing to the third panel;

wherein the second panel is: i) adjacent to the first panel and the third panel; and ii) opposing to the fourth panel;

wherein each of the first, second, third, and fourth panels has a respective upper edge, lower edge, first side edge, and second side edge, wherein the first side edge and the second side edge are opposing;

wherein the respective upper edges of the first, second, third, and fourth panels are sealed to form a top seal, the respective lower edges of the first, second, third, and fourth panels are sealed to form a bottom seal;

wherein the second side edge of the first panel is sealed to the first side edge of the second panel to form a first corner seal;

wherein the second side edge of the second panel is sealed to the first side edge of the third panel to form a second corner seal;

wherein the second side edge of the third panel is sealed to the first side edge of the fourth panel to form a third corner seal;

wherein the second side edge of the fourth panel is sealed to the first side edge of the first panel to form a fourth corner seal; and wherein a line of weakness extends from at least a portion of the first panel into at least a portion of the first corner seal, wherein the line of weakness is: a dashed line in the first panel; and a continuous line in the first corner seal, and wherein the dashed line in the first panel and the continuous line in the first corner seal abut.

In another aspect, the present invention is directed to a process for making an easy opening bag containing a consumer product sealed therein comprising the steps of:

a) moving a continuous web of film having a line of weakness, in a machine direction, wherein said web has a first edge and an opposing second edge;

b) forming four corner seals in the web along the machine direction, wherein each of the four corner seals are separated by panel zones, wherein the line of weakness extends from at least one panel zone and through at least one corner seal adjoining the at least one panel zone, and wherein the line of weakness is:

i) a dashed line in the at least one panel zone; and ii) a continuous line in the adjacent corner seal;

c) sealing the first edge and second edge of the web, to form a tube with a fin seal;

d) sealing the tube with the fin seal laterally to form a bottom seal in the tube;

e) cutting the tube with the bottom seal laterally to define a bag having a circumferential edge, wherein the circumferential edge defines an opening into an internal volume of the bag;

f) depositing the consumer product into the internal volume of the bag via the opening to provide a bag containing the consumer product; and g) sealing the bag containing the consumer product laterally to form a top seal in the bag thereby providing the easy opening bag containing the consumer product.

DETAILED DESCRIPTION OF THE INVENTION

Definitions

Figure 1:
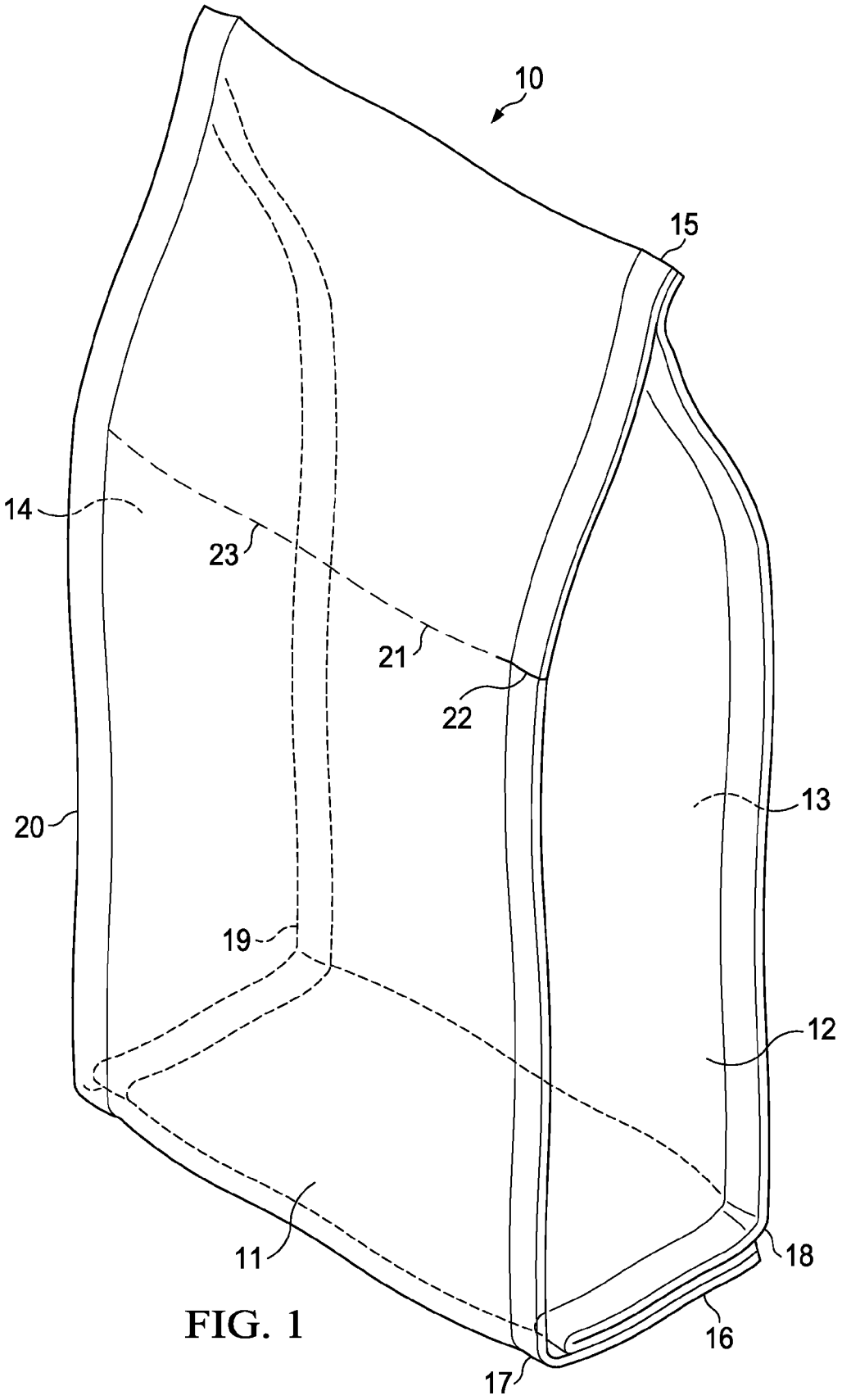
FIG. 1 is a perspective view of a bag according to one embodiment of the present invention.

As used herein, the term "bag" refers to a flexible packaging container, casing, unit, pouch, etc., for which a product is contained in and used for storage, transport, and dispensing. A bag is made of a film. A consumer product bag is a bag that contains one or more consumer products.

As used herein, the term "consumer product" means baby care, beauty care, fabric and home care, family care, feminine care, health care, snack and/or beverage products or devices, and the like, intended to be used or consumed in the form in which it is sold, and not intended for subsequent commercial manufacture or modification. Such products include but are not limited to diapers, bibs, wipes; products for and/or methods relating to treating hair (human, dog, and/or cat), including bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric softening, laundry detergent, laundry and rinse additive and/or care, hard surface cleaning and/or treatment, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, Rx pharmaceuticals, pet health and nutrition, and water purification; processed food products intended primarily for consumption between customary meals or as a meal accompaniment; and coffee.

As used herein, the term "panel" refers to a substantially flat portion of a bag. Typically the bag has several panels each of which is made of a film. Non-limiting examples include front panel, back panel, and side panels. Typically, the front panel of a bag, particularly a consumer product bag, is printed with pictures or product logos that are intended to attract users' attention. The back panel is typically opposing the front panel. The side panels are typically opposing each other and are connected between the side panels. The panels may be generally of the same size relative to each other. Alternatively, the front and back panels are generally relatively of the same size and the side panels are generally relatively of the same size, and the front and back panels are larger than the side panels. The terms "first panel", "second panel", "third panel", and "fourth panel", as used herein, do not necessarily refer to the relative position of a panel in a bag. For example, a first panel could be a front panel, a back panel, or a side panel, but preferably be a back panel.

As used herein, the term "seal" refers to joining two or more panels or portions of a bag to prevent leakage of the contents contained in the bag or provide structural integrity to the bag. Typical seals can be formed by applying heat and/or pressure to two or more overlapping portions of the bag. Seals can be identified according to their locations in the bag. Non-limiting examples of seals include top seal, bottom seal, corner seal, and fin seal. The term "corner seal" refers to the seal of a bag formed by two adjacent panels. The term "fin seal" refers to the seal usually extending substantially vertically on a panel, preferably the back panel of a bag. Typically at least a portion of the axis of a corner seal or fin seal is, when the bag is in an upright configuration, substantially orthogonal to the shelf or other surfaces where the bag is displayed (i.e., as the bag would typically be displayed on shelf). The axis of a top seal or bottom seal is typically substantially perpendicular to the axis of a corner seal or fin seal and typically substantially parallel to the shelf or other surfaces where the bag is displayed. The bottom seal is in closer proximity to the shelf or other surfaces where the bag is displayed than the top seal.

As used herein, the term "line of weakness" refers to a line in a bag that weakens the film of the bag in a desired trajectory of bag rupture or separation. There may be different types of lines of weakness depending on how the line is made into the film. Non-limiting examples of a line of weakness include a continuous line and a dashed line. The term "continuous line" refers to a line that is cut into the film or a removed line extending uninterruptedly in a portion of a bag, having a depth in the film less than the full thickness of the film (such that there is still a barrier between the inside and outside of the film). The term "dashed line" refers to a line formed by a plurality of perforations and a plurality of non-perforations extending in a portion of a bag, wherein each perforation of the plurality of perforations is separated by a non-perforation of the plurality of non-perforations. The term "perforation", as used herein, refers to a bore or slit that is cut into or removed from the film, having a depth less than or equal to the full thickness of the film. The term "non-perforation", as used herein, refers to a line without any bores or slits, or a bore or slit so long as the depth thereof is less than the adjoining perforation.

As used herein, the term "starting notch" refers to a cut in the film of a bag for initiating a tearing by a user. A starting notch may be provided in any portions of a bag, e.g., a panel, a corner seal, or a fin seal, but preferably in a fin seal of a bag. The starting notch may be provided abutting a line of weakness, preferably abutting and in the same axis as the line of weakness.

As used herein, the term "film" refers to a relatively thin, flexible material that is suitable for use in bags. The film can be made from a single layer (single-layer) or multiple layers (multi-layer).

As used herein, the terms "comprise", "comprises", "comprising", "include", "includes", "including", "contain", "contains", and "containing" are meant to be non-limiting, i.e., other steps and other ingredients which do not affect the end of result can be added. The above terms encompass the terms "consisting of" and "consisting essentially of".

As used herein, the articles including "a" and "an" when used in a claim, are understood to mean one or more of what is claimed or described.

FIG. 1 shows one embodiment of an easy opening bag 10 of the present invention. The bag 10 is illustrated as having a first panel 11, a second panel 12, a third panel 13, and a fourth panel 14. The first panel 11, adjacent to the second panel 12 and the fourth panel 14, is opposing to the third panel 13. The second panel 12, adjacent to the first panel 11 and the third panel 13, is opposing to the fourth panel 14. Each of the first, second, third, and fourth panels 11, 12, 13, 14 has a respective upper edge, lower edge, first side edge, and second side edge, wherein the first side edge and the second side edge are opposing. Preferably, the upper edge and the lower edge are opposing. The respective upper edges of the first, second, third, and fourth panels 11, 12, 13, 14 are sealed to form a top seal 15, and the respective lower edges of the first, second, third, and fourth panels 11, 12, 13, 14 are sealed to form a bottom seal 16. Preferably, the top seal 15 and the bottom seal 16 are opposing. The second side edge of the first panel 11 is sealed to the first side edge of the second panel 12 to form a first corner seal 17, the second side edge of the second panel 12 is sealed to the first side edge of the third panel 13 to form a second corner seal 18, the second side edge of the third panel 13 is sealed to the first side edge of the fourth panel 14 to form a third corner seal 19, and the second side edge of the fourth panel 14 is sealed to the first side edge of the first panel 11 to form a fourth corner seal 20. The bag 10 is provided with a line of weakness 21, extending from at least a portion of the first panel 11 into at least a portion of the first corner seal 17. The line of weakness 21 is: a dashed line 23 in the first panel 11 and a continuous line 22 in the first corner seal 17. The dashed line 23 in the first panel 11 abuts the continuous line 22 in the first corner seal 17. Preferably, the line of weakness 21 extends from at least a portion of the first panel 11 and extends through an entire width of the first corner seal 17. More preferably, the line of weakness 21 extends through the entire width of the first corner seal 17 and the first panel 11, as shown in FIG. 1.

Preferably, the line of weakness 21 extends through the entire width of the first corner seal 17 and the first panel 11 and extends into at least a portion of the fourth corner seal 20. The line of weakness 21 is a continuous line 22 in the fourth corner seal 20, wherein the continuous line 22 in the fourth corner seal 20 abuts the dashed line 23 in the first panel 11. More preferably, the line of weakness 21 extends through the entire width of the first corner seal 17, the first panel 11, and the fourth corner seal 20.

Figure 2:
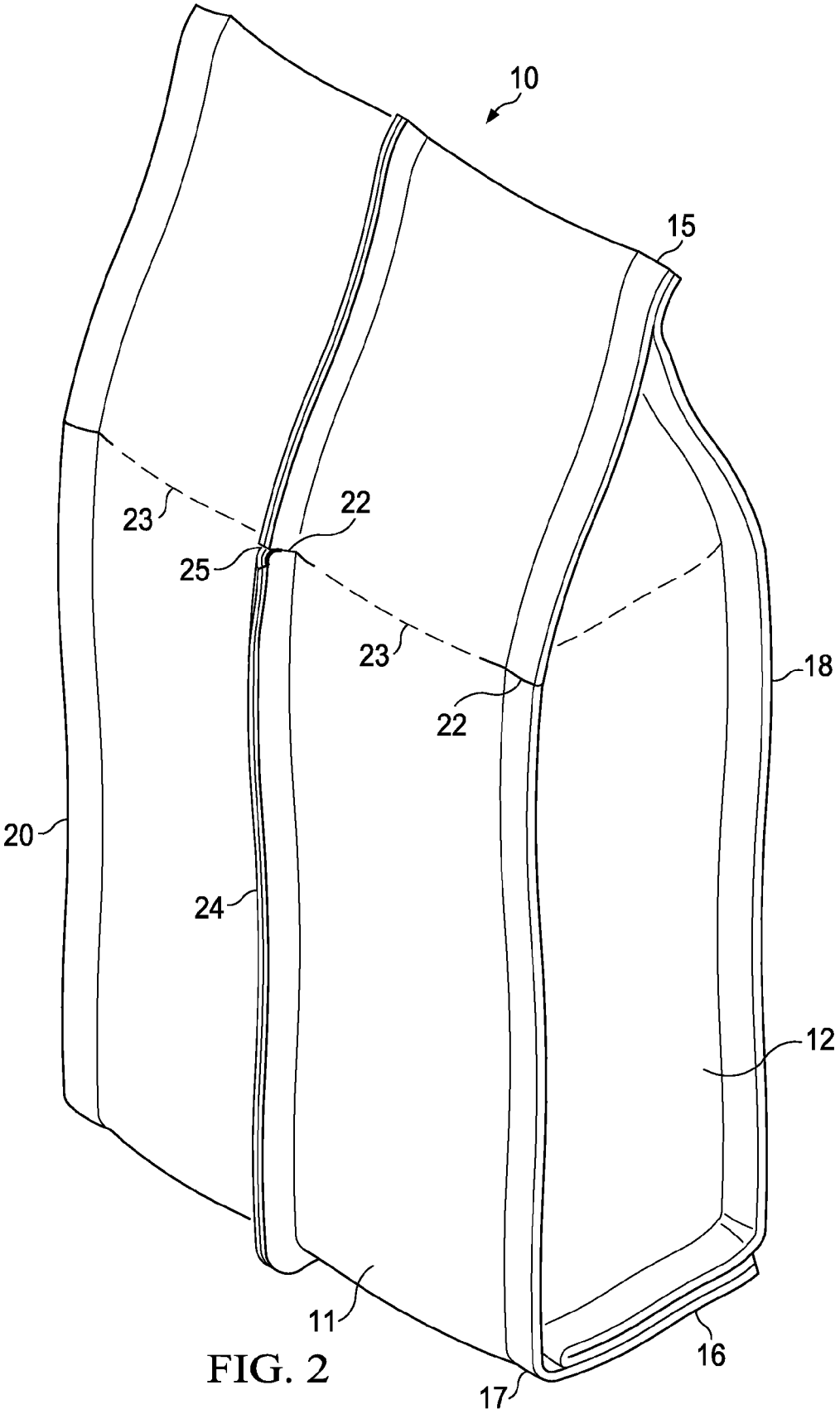
FIG. 2 is a perspective view of a bag according to one preferred embodiment of the present invention.

Preferably, the line of weakness 21 further extends into at least a portion of the second panel 12. The line of weakness 21 is a dashed line 23 in the second panel 11, wherein the continuous line 22 in the first corner seal 17 abuts the dashed line 23 in the second panel 11. More preferably, the line of weakness 21 extends through the entire width: of the fourth corner seal 20, the first panel 11, the first corner seal 17, and the second panel 11, as shown in FIG. 2.

Figure 3:
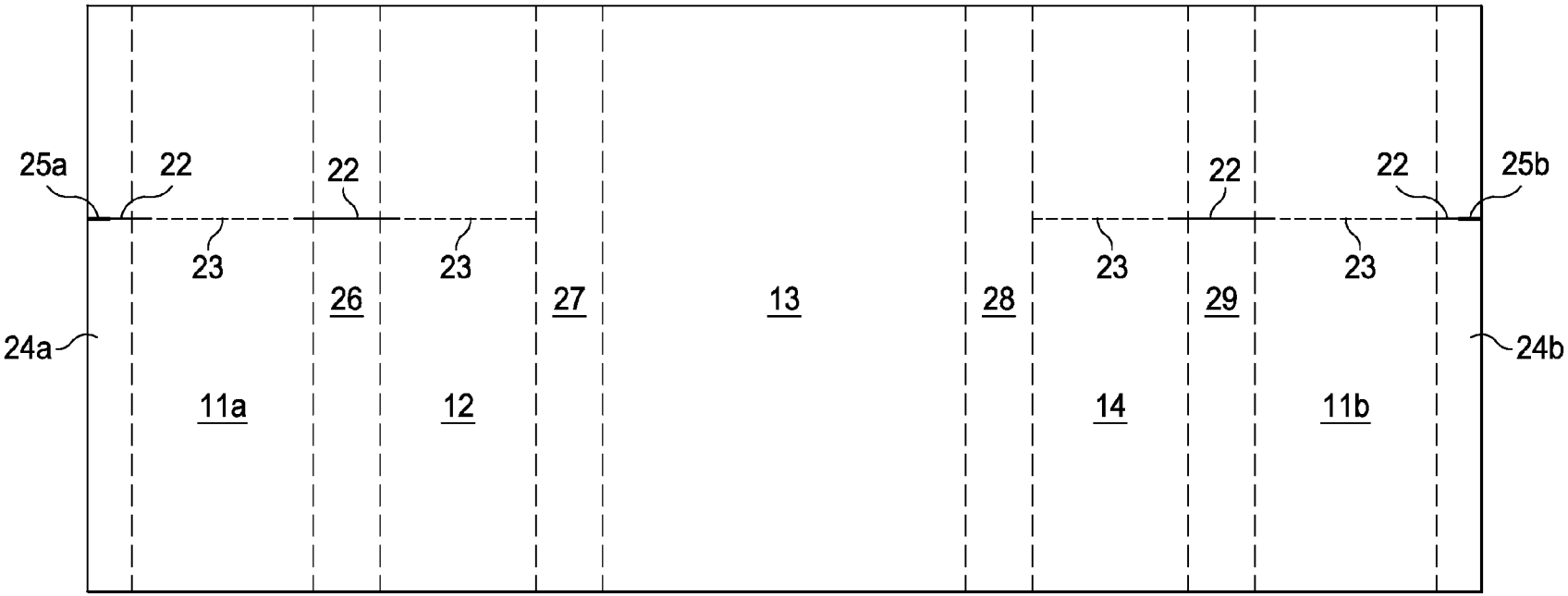
FIG. 3 is a sheet of film forming a bag according to another preferred embodiment of the present invention.

Preferably, the line of weakness 21 further extends into at least a portion of the fourth panel 14. The line of weakness 21 is a dashed line 23 in the fourth panel 14, wherein the continuous line 22 in the fourth corner seal 20 abuts the dashed line 23 in the fourth panel 14. More preferably, the line of weakness 21 extends through the entire width: of the fourth panel 14, the fourth corner seal 20, the first panel 11, the first corner seal 17, and the second panel 11, as shown in FIG. 3.

In one preferred embodiment, the line of weakness 21 does not extend circumferentially through the entire width of the first, second, third, and fourth panels 11, 12, 13, 14 and the first, second, third, and fourth corner seals 17, 18, 19, 20. For example, the line of weakness 21 extends through the entire width of the second corner seal 18, the second panel 12, the first corner seal 17, the first panel 11, the fourth corner seal 20, the fourth panel 14, and the third corner seal 19, whilst not extending into the third panel 13. Such a non-circumferential extension of the line of weakness enables the user to open the bag easily without causing litter, i.e., without completely tearing away a portion of the bag when opening the bag.

In an alternative embodiment, the line of weakness 21 is selected from either a continuous line 22 or a dashed line 23, and wherein the line of weakness 21 extends circumferentially through the entire width of: the first, second, third, and fourth panels 11, 12, 13, 14; and the first, second, third, and fourth corner seals 17, 18, 19, 20. The line of weakness 21 is a continuous line 22 in at least one of the second, third, and fourth corner seals 17, 18, 19, 20, preferably a continuous line 22 in all of the second, third, and fourth corner seals 17, 18, 19, 20. This enables the entire top of the bag to be separated upon opening. This embodiment is particularly useful in those applications where the entire contents of the bag are to be emptied in a single operation, e.g., to pour the entire contents of a re-fill pouch into a bottle.

The line of weakness 21 herein may be a curvilinear line (like a sinusoidal line) or a linear line, but preferably is a linear line. In one embodiment, at least a portion of an axis of the first, second, third, and fourth corner seals 17, 18, 19, 20, are configured substantially parallel with respect to each other, as shown in FIGS. 1 and 2. Preferably, the axis of the line of weakness 21 is substantially perpendicular to the portion of the axis of the first, second, third, and fourth corner seals 17, 18, 19, 20 that are configured substantially parallel with respect to each other. The line of weakness 21 is preferably provided in the bag 10 in closer proximity to the top seal 15 than the bottom seal 16. More preferably, the continuous line 22 through the first corner seal 17, in its entirety, is within 1 about cm to about 10 cm, preferably about 2 cm to about 8 cm, from the top seal 15.

FIG. 2 shows a preferred embodiment of the bag 10 of the present invention. The first panel 11 further comprises a fin seal 24 extending from the top seal 15 to the bottom seal 16. The fin seal 24 can be positioned in any portion of the first panel 11, but preferably substantially in the middle of the first panel 11. Preferably, at least a portion of an axis of the fin seal 24 is substantially parallel to the portion of the axis of the first, second, third, and fourth corner seals 17, 18, 19, 20 that are configured substantially parallel with respect to each other. The line of weakness 21 extends into at least a portion of the fin seal 24, preferably extends through the entire width of the fin seal 24, and more preferably is a continuous line 22 extending through the entire width of the fin seal 24.

The fin seal 24 may further comprise a starting notch 25 abutting the line of weakness 21 in the fin seal 24 for initiating a tearing. The starting notch 25 extends the full thickness of the fin seal 24. Preferably, the starting notch 25 abuts and is in the same axis as the line of weakness 21 in the fin seal 24. Having the same axis in the starting notch 25 and the line of weakness 21 facilitates easy opening of the bag 10 along the line of weakness 21. Preferably, the starting notch 25 has a length less than the width of the fin seal 24, more preferably has a length of at least about 2 mm less than the width of the fin seal 24. In one embodiment, the starting notch 25 has a length of from about 0.1 mm to about 10 mm, preferably from about 0.3 mm to about 5 mm. In one preferred embodiment, the bag 10 comprises text or graphic indicating to the user the location of the starting notch 25 on the bag and optionally the location of the line of weakness 21. Thus, the user can anticipate the trajectory of the tearing and/or how far the user should continue in conducting the tearing.

The continuous line 22 of the present invention may extend from the corner seal(s) 17, 18, 19, 20 or the fin seal 24 into the adjacent panel(s) 11, 12, 13, 14, thus ensuring a controlled tearing following the line of weakness 21. However, too long of an extension of the continuous line 22 to the adjacent panel(s) 11, 12, 13, 14 is not desirable as it may weaken the overall structural integrity of the bag 10. In one preferred embodiment, the continuous line 22 extends by at least about 1 mm, alternatively from about 1 mm to about 30 mm, on either side, preferably both sides, of the respective corner seal(s) 17, 18, 19, 20. In another preferred embodiment, the continuous line 22 in the fin seal 24 extends by at least about 1 mm, alternatively from about 1 mm to about 20 mm, on either side, preferably both sides, of the fin seal 24, as shown in FIG. 3.

Referring now to FIG. 3, there is shown a sheet of film that forms a bag 10 according to one preferred embodiment of the present invention. FIG. 3 shows four corner seal portions 26, 27, 28, 29 that will form the first, second, third, and fourth corner seals 17, 18, 19, 20, respectively. In the manufacturing process, the four corner seal portions 26, 27, 28, 29 will be bi-folded and sealed inside surface against inside surface, thereby forming the first, second, third, and fourth corner seals 17, 18, 19, 20, respectively. FIG. 3 also shows two fin seal portions 24*a*, 24*b* that will seal to form the fin seal 24. Two cuts 25*a*, 25*b* provided in the two fin seal portions 24*a*, 24*b*, respectively, will form the starting notch 25. Furthermore, the first panel 11 is divided into two first panel portions, 11*a*, 11*b*, and the two first panel portions 11*a*, 11*b* are connected with the two fin seal portions 24*a*, 24*b*, respectively.

The first, second, third, and fourth corner seals 17, 18, 19, 20 and fin seal 24 herein can be of any width known in the art. The first, second, third, and fourth corner seals 17, 18, 19, 20 may have a width of from about 1 mm to about 30 mm, preferably from about 5 mm to about 15 mm. The first, second, third, and fourth corner seals 17, 18, 19, 20 may have different widths or the same width, preferably have the same width. The fin seal 24 may have a width of from about 1 mm to about 20 mm, preferably from about 3 mm to about 10 mm. In one embodiment, the fin seal 24 has the substantially the same width as one or more corner seals 17, 18, 19, 20.

The first, second, third, and fourth corner seals 17, 18, 19, 20 herein can be of any thickness depending on the film, manufacturing process, etc. The first, second, third, and fourth corner seals 17, 18, 19, 20 are thicker than the first, second, third, and fourth panels 11, 12, 13, 14. In one embodiment, the first, second, third, and fourth corner seals 17, 18, 19, 20 and fin seal 24 have a thickness of from about 10 μm to about 1,000 μm, preferably from about 50 μm to about 700 μm, more preferably from about 100 μm to about 500 μm.

The arrangements of the perforations and non-perforations in the dashed line 23 herein may be varied as known in the art. In one embodiment, the length of each perforation is from about 0.05 mm to about 1 mm, preferably from about 0.1 mm to about 0.4 mm, and the length of each non-perforation is from about 0.1 mm to about 2 mm, preferably from about 0.2 mm to about 1 mm. Preferably, the length of the perforation to the non-perforation is in a ratio of from about 3:1 to about 1:3, alternatively from about 2:1 to about 1:2, alternatively 1:1.

The easy opening bag 10 herein can be of any size known in the art. In one embodiment, the bag 10 is configured to have an internal volume of from about 250 $cm^3$ to about 10,000 $cm^3$, preferably from about 500 $cm^3$ to about 3,000 $cm^3$.

Preferably, the bag 10 herein is configured to contain a consumer product. In one embodiment, the bag 10 further contains a consumer product. The consumer product may be in the form of liquid, gel, granule, etc. Preferably, the consumer product is in the form granule, more preferably is a granular laundry detergent. When containing a consumer product, the bag 10 is configured to have a mass of from about 0.1 kg to about 10 kg, preferably from about 0.3 kg to about 5 kg.

In one embodiment, the easy opening bag 10 herein comprises a re-closing means used to close the bag 10 after the bag 10 has been torn open along the line of weakness 21. The re-closing means herein may be selected from those known in the art, e.g., a zipper, an adhesive tape, a folding means, and a mechanical fastener. See, US2008/131035A1. Preferably, the re-closing means is a mechanical fastener, more preferably hook and loop, attached to the bag 10. More preferably, at least one piece of the mechanical fastener is placed on one panel of the bag 10 while another piece of the mechanical fastener is placed on the opposing panel of the bag 10. The piece of the mechanical fastener is preferably a horizontal strip. Even more preferably, two interacting horizontal strips are attached to the inside surface of the first panel 11 and the third panel 13 just below the line of weakness 21. The re-closing means allows users to open and securely close the bag 10 as many times as product uses, thereby protecting the consumer product contained in the bag 10 from spillage, humidity, and other external factors that might affect the integrity of the product.

Bag Film

The easy opening bag 10 of the present invention can comprise any suitable film known in the art. The film may be made from paper, plastic, or a combination thereof. Preferably, the film is made from a plastic selected from the group consisting of polyethylene (PE), polyethylene terephthalate (PET), oriented polypropylene (OPP), biaxially oriented polypropylene (BOPP), and a combination thereof. The PE herein is selected from the group consisting of high density polyethylene (HDPE), medium density polyethylene (MDPE), low density polyethylene (LDPE), linear low density polyethylene (LLDPE), metallocene polyethylene (mPE), biaxially oriented polyethylene (BOPE), and a combination thereof.

Each of non-sealed portions of the bag 10, i.e., the first, second, third, and fourth panels 11, 12, 13, 14, comprises either a multi-layer or a single-layer film, preferably a multi-layer film. Preferably, the multi-layer film comprises an outer layer and an inner layer, more preferably is a two-layer film comprising an outer layer and an inner layer. The inner layer makes contact with contents contained in the bag 10, whereas the outer layer typically forms the outermost surface of the bag 10, e.g., the exterior portion of the bag 10. The outer layer and the inner layer may be independently selected from PE, PET, OPP, or BOPP. More preferably, the two-layer film is a PET/PE film wherein the PET acts as the outer layer, BOPP/PE film wherein the BOPP acts as the outer layer, or PE/PE film, even more preferably the two-layer film is a PE/PE film. Additionally, it is understood that each of sealed portions of the bag 10, i.e., the first, second, third, and fourth corner seals 17, 18, 19, 20, the top seal 15, the bottom seal 16, and the fin seal 24, comprises more layers than the non-sealed portions. For example, when the first and second panels 11, 12 are PE/PE film, the first corner seal 17 formed by sealing the second side edge of the first panel 11 and the first side edge of the second panel 12 is either PE/PE/PE/PE film or PE/PE/PE film as the two inner layers of PE may melt into one layer of PE in the sealing process. In another embodiment, the multi-layer film is a three-layer film, preferably the middle layer of the three-layer film is BOPE. See, e.g., JP4498913B1. In yet another embodiment, the multi-layer film comprises at least one foamed thin layer which comprises bubbles, void volume, or cells. See, e.g., U.S. Pat. No. 8,173,233, col. 4, lines 15-22.

The line of weakness 21 herein can be of any depth depending on factors like the bag film, the arrangements of the line of weakness 21 in the bag, the methods by which seals are formed, etc. In one embodiment, the line of weakness 21, either the continuous line 22 or the dashed line 23, is in the outer layer of a multi-layer film only. Alternatively, the continuous line 22 is in the outer layer of a multi-layer film only, and the dashed line 23 (i.e., the perforations of the dashed line 23) penetrates through all the layers of a multi-layer film. Preferably, the multi-layer film is a two-layer film, and the continuous line 22 is in the outer layer of the two-layer film only, and the dashed line 23 (i.e., the perforations of the dashed line 23) penetrates through both the inner layer and outer layer of the two-layer film.

Method of Producing the Line of Weakness

The line of weakness 21 of the present invention can be produced by any suitable method known in the art. Non-limiting examples of the method include but are not limited to: laser scoring, mechanical scoring, embossing, or a combination thereof, preferably laser scoring.

The method of laser scoring uses at least one laser to produce a line of weakness in a film. First a laser beam with sufficient wattage to evaporate a portion of the film is focused onto the film. The use of laser technology allows for very accurate control of the depth or penetration of the line of weakness, from very slight scoring to complete perforation of the film. A laser using any form of electromagnetic radiation can be used. Moreover, the speed of the film and the movement of the laser beam are dependent upon the pattern and depth of the line of weakness desired as well as the type of film used. Suitable methods for laser scoring are disclosed in U.S. Pat. Nos. 3,626,143, 3,790,744, 3,909,582 all to American Can Company and U.S. Pat. Nos. 5,158,499 and 5,229,180 to American National Can Company, U.S. Pat. No. 5,001,325 to LPF Verpakkingen B. V, U.S. Pat. No. 4,743,123 to Wavin B. V., Japanese Patents 09133018, 07008283 and 06103200 all to Dainippon Printing Company.

Another suitable method for producing a line of weakness is mechanical scoring, like the use of blades. Typically, the blades are installed on an engraving cylinder, which is mounted directly on the film processing machinery so that the cuts are made prior to formation of the bag. Different blade patterns can be used to get different patterns in the line of weakness. The pressure applied to the blades is also varied during the process to control the dimensions and depth of the cuts to ensure an easy opening bag.

Embossing is another alternative method for producing a line of weakness. The embossing method weakens the film in specific areas by means of pressure, temperature, time and a deforming profile. The desired results are achieved by changing the caliper and/or film structure at the embossed trajectory. The basic equipment used for embossing consists of a sealing jaw capable of pressing against a back plate. A deforming profile is fixed to the jaw and heated. The film is pressed between the deforming profile and the back plate. The main variables known to affect this process include: heating temperature, cooling temperature, pressure, heating time, cooling time, film tension while embossing, film tension after embossing, back plate material, back plate thickness, back plate temperature, jaw pattern and jaw thickness. The embossing unit would be installed after an unwinding station of film, preferably incorporated into the packaging equipment line. Suitable examples of embossing are described in U.S. Pat. No. 5,878,549 to American National Can Company.

Test Method

The line of weakness 21 of the present invention can be characterized by the ASTM-D882 Tensile Method on thin plastic sheeting. In accordance with ASTM-D882 Tensile Method, the line of weakness 21 must be parallel to the shortest side of the sample (i.e. width). Specifically, the line of weakness 21 is characterized by two parameters obtained from ASTM-D882 Tensile Method. The first parameter is yield stress value, and the second parameter is rupture stress value. A comparable control film is taken as the reference for generating the yield stress value and the rupture stress value. The comparable control film represents an un-weakened film, i.e., the same film without lines of weakness.

In one embodiment, the yield stress value of the continuous line 22 is equal to or less than the yield stress value of the dashed line 23, and the yield stress value of the dashed line 23 is no less than 90% of the yield stress value of the comparable control film, as determined by the ASTM-D882 Tensile Method. In a preferred embodiment, the yield stress value and rupture stress value of continuous line 22 are equal to or less than the yield stress value and rupture stress value of the dashed line 23, respectively, and the yield stress value and rupture stress value of the dashed line 23 are no less than 90% of the yield stress value and rupture stress value of the comparable control film, respectively, as determined by the ASTM-D882 Tensile Method.

The bag 10 with corner seals of the present invention provides an easy opening property whilst maintaining good standability on shelf. Specifically, the arrangements of the line of weakness 21 in the bag 10, particularly the arrangements of the continuous line 22 in the thicker corner seal(s) 17, 18, 19, 20, enable a controlled tearing of the bag 10 along the line of weakness 21 including crossing the corner seal(s) 17, 18, 19, 20. Such arrangements of the line of weakness 21 include the positions of the line of weakness 21 in the bag 10, the depth of the line of weakness 21, the length of the line of weakness 21, etc. Other factors like the selection of the type and thickness of the film, and the width of the corner seals 17, 18, 19, 20, also help in ensuring a precisely controlled tearing of the bag 10. In addition, it is understood that the good standability of the bag 10 is generally due to thicker corner seals 17, 18, 19, 20.

Furthermore, the line of weakness 21 is arranged in the bag 10 such that it does not significantly weaken the overall structural integrity of the bag 10. A desired yield stress value is achieved by adjusting the abovementioned factors, e.g., the depth and length of the line of weakness 21, the type and thickness of the film, and the width of the corner seals 17, 18, 19, 20. For example, the continuous line 22 is arranged in the corner seal(s) 17, 18, 19, 20 only, rather than in all of the portions of the bag. Thus, the bag 10 is rigid enough to withstand typical filling, packing, handing, and other distribution related processes.

Process for Making the Bag

The bag 10 of the present invention can be formed by any methods known in the art, e.g., vertical form, fill, and seal (VFFS) and horizontal form, fill, and seal (HFFS). One method for forming the bag 10 from a continuous web of film is described in U.S. Pat. No. 5,054,619, issued to Muckenfuhs. Preferably, the line of weakness 21 is produced in a web of film before forming the bag 10.

Figure 4:
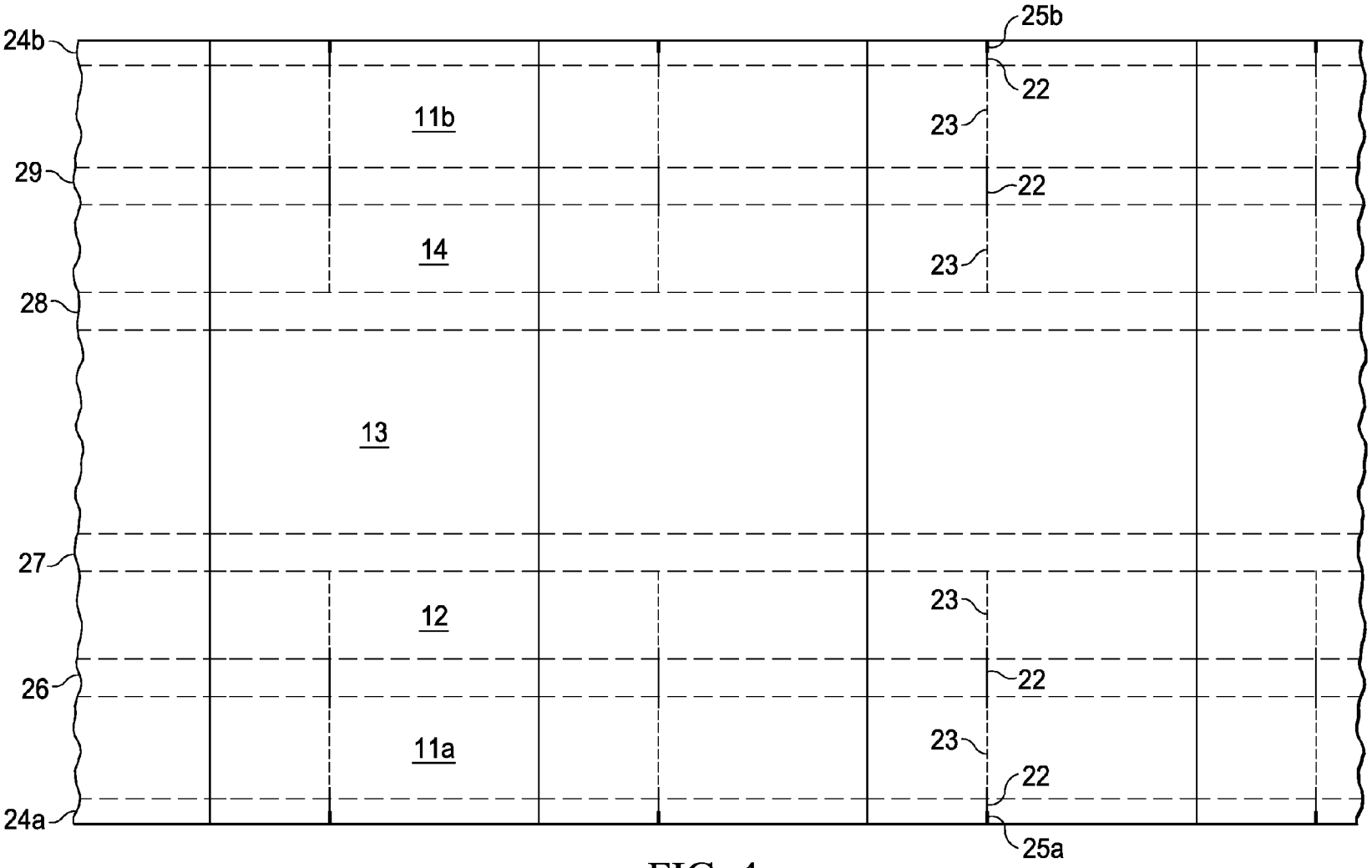
FIG. 4 is a diagrammatic view of a section of web of film illustrating one process embodiment of the present invention.

One aspect of the present invention is directed to a preferred process for making an easy opening bag containing a consumer product sealed therein, as shown in FIG. 4, comprising the steps of:

a) moving a continuous web of film having a line of weakness, in a machine direction, wherein said web has a first edge and an opposing second edge;

b) forming four corner seals in the web along the machine direction, wherein each of the four corner seals are separated by panel zones, wherein the line of weakness extends from at least one panel zone and through at least one corner seal adjoining the at least one panel zone, and wherein the line of weakness is:

i) a dashed line in the at least one panel zone; and ii) a continuous line in the adjacent corner seal;

c) sealing the first edge and second edge of the web, to form a tube with a fin seal;

d) sealing the tube with the fin seal laterally to form a bottom seal in the tube;

e) cutting the tube with the bottom seal laterally to define a bag having a circumferential edge, wherein the circumferential edge defines an opening into an internal volume of the bag;

f) depositing the consumer product into the internal volume of the bag via the opening to provide a bag containing the consumer product; and g) sealing the bag containing the consumer product laterally to form a top seal in the bag thereby providing the easy opening bag containing the consumer product.

The line of weakness may be produced in the web of film before forming the bag, i.e., before step a). Alternatively, the line of weakness may be produced in the web of film in the process for making the bag, e.g., in step a) or step b).

The line of weakness in the web of film may be produced by any suitable methods known in the art, e.g., laser scoring, mechanical scoring, embossing, or a combination thereof, preferably by laser scoring. Preferably, the line of weakness is substantially perpendicular to the machine direction.

Unless otherwise indicated, all percentages, ratios, and proportions are calculated based on weight of the total composition. All temperatures are in degrees Celsius (° C.) unless otherwise indicated. All component or composition levels are in reference to the active level of that component or composition, and are exclusive of impurities, for example, residual solvents or by-products, which may be present in commercially available sources.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An easy opening bag (10), comprising a first panel (11), a second panel (12), a third panel (13), and a fourth panel (14), wherein said first panel (11) is: i) adjacent to said second panel (12) and said fourth panel (14); and ii) opposing to said third panel (13);

wherein said second panel (12) is: i) adjacent to said first panel (11) and said third panel (13); and ii) opposing to said fourth panel (14);

wherein each of said first, second, third, and fourth panels (11, 12, 13, 14) has a respective upper edge, lower edge, first side edge, and second side edge, wherein the first side edge and the second side edge are opposing;

wherein the respective upper edges of said first, second, third, and fourth panels (11, 12, 13, 14) are sealed to form a top seal (15), the respective lower edges of said first, second, third, and fourth panels (11, 12, 13, 14) are sealed to form a bottom seal (16);

wherein the second side edge of said first panel (11) is sealed to the first side edge of said second panel (12) to form a first corner seal (17);

wherein the second side edge of said second panel (12) is sealed to the first side edge of said third panel (13) to form a second corner seal (18);

wherein the second side edge of said third panel (13) is sealed to the first side edge of said fourth panel (14) to form a third corner seal (19);

wherein the second side edge of said fourth panel (14) is sealed to the first side edge of said first panel (11) to form a fourth corner seal (20); and wherein a line of weakness (21) extends from at least a portion of said first panel (11) into at least a portion of said first corner seal (17), wherein said line of weakness (21) is: a dashed line (23) in said first panel (11); and a continuous line (22) in said first corner seal (17), and wherein said dashed line (23) in said first panel (11) and said continuous line (22) in said first corner seal (17) abut, wherein an axis of said bottom seal (16) is substantially perpendicular to an axis of said first, second, third, and fourth corner seals (17, 18, 19, 20) and substantially parallel to a surface where said bag is displayed, wherein said line of weakness (21) does not extend circumferentially through the entire width of: said first, second, third, and fourth panels (11, 12, 13, 14), and said first, second, third, and fourth corner seals (17, 18, 19, 20), wherein the yield stress value of said continuous line (22) is equal to or less than the yield stress value of said dashed line (23), and the yield stress value of said dashed line (23) is no less than 90% of the yield stress value of a comparable control film, as determined by the ASTM-D882 Tensile Method, wherein the bag (10) further contains a consumer product, wherein said consumer product is a granular laundry detergent.

2. The bag according to claim 1, wherein said line of weakness (21) extends through the entire width of: said first corner seal (17), said first panel (11), and said fourth corner seal (20); wherein said line of weakness (21) is a continuous line (22) in said fourth corner seal (20), and wherein said continuous line (22) in said fourth corner seal (20) and said dashed line (23) in said first panel (11) abut.

3. The bag according to claim 2, wherein said line of weakness (21) further extends into at least a portion of said second panel (12); wherein said line of weakness (21) is a dashed line (23) in said second panel (12); and wherein said continuous line (22) in said first corner seal (17) and said dashed line (23) in said second panel (12) abut.

4. The bag according to claim 3, wherein said line of weakness (21) further extends into at least a portion of said fourth panel (14); wherein said line of weakness (21) is a dashed line (23) in said fourth panel (14); and wherein said dashed line (23) in said fourth panel (14) and said continuous line (22) in said fourth corner seal (20) abut.

5. The bag according to claim 1, wherein said continuous line (22) extends by at least about 1 mm on either side of the respective corner seal.

6. The bag according to claim 5, wherein said line of weakness (21) is a linear line.

7. The bag according to claim 6, wherein at least a portion of an axis of said first, second, third, and fourth corner seals (17, 18, 19, 20) are configured substantially parallel with respect to each other.

8. The bag according to claim 7, wherein said line of weakness (21) is substantially perpendicular to the portion of the axis of said first, second, third, and fourth corner seals (17, 18, 19, 20) that are configured substantially parallel with respect to each other.

9. The bag according to claim 8, wherein said continuous line (22) through said first corner seal (17), in its entirety, is within 1 about cm to about 10 cm, preferably about 2 cm to about 8 cm, from said top seal (15).

10. The bag according to claim 6, wherein said first panel (11) further comprises a fin seal (24) extending from said top seal (15) to said bottom seal (16), preferably at least a portion of an axis of said fin seal (24) is substantially parallel to the portion of the axis of said first, second, third, or fourth corner seals (17, 18, 19, 20) that are configured substantially parallel with respect to each other.

11. The bag according to claim 10, wherein said line of weakness (21) is a continuous line (22) extending through the entire width of said fin seal (24).

12. The bag according to claim 11, wherein said fin seal (24) further comprises a starting notch (25) abutting said continuous line (22).

13. The bag according to claim 12, wherein said continuous line (22) in said fin seal (24) extends by at least about 1 mm on either side of said fin seal (24).

14. The bag according to claim 1, wherein said first, second, third, and fourth panels (11, 12, 13, 14) comprise a two-layer film comprising an outer layer and an inner layer, wherein said outer layer and said inner layer are independently selected from polyethylene (PE), polyethylene terephthalate (PET), oriented polypropylene (OPP), or biaxially oriented polypropylene (BOPP), preferably said two-layer film is a PET/PE film, BOPP/PE film, or PE/PE film, more preferably said two-layer film is a PE/PE film.

15. The bag according to claim 14, wherein said line of weakness (21) is in the outer layer only, and said dashed line (23) penetrates through both the outer layer and inner layer.

16. The bag according to claim 1, wherein said line of weakness (21) is formed by laser scoring, mechanical scoring, embossing, or a combination thereof, preferably laser scoring.

* * * * *